US005827003A

United States Patent [19]

Konig

[11] Patent Number: 5,827,003

[45] Date of Patent: Oct. 27, 1998

[54] RING BINDER WITH ALIGNMENT BLADE TONGUES

[75] Inventor: Winfried Konig, Berlin, Germany

[73] Assignee: Off Data GmbH, Berlin, Germany

[21] Appl. No.: 690,336

[22] Filed: Jul. 26, 1996

[30] Foreign Application Priority Data

Jul. 29, 1995 [DE] Germany ..... 195 27 872.0

[51] Int. Cl.[6] ..... B42F 3/00; B42F 13/10

[52] U.S. Cl. ..... 402/13; 281/15.1; 402/19; 402/22; 402/68; 402/80 P

[58] Field of Search ..... 402/8, 13, 14, 402/15, 19, 21, 22, 23, 60, 61, 64, 68, 80 P; 281/15.1, 19.1, 21.1, 22, 28

[56] References Cited

U.S. PATENT DOCUMENTS 4,784,507 11/1988 Vetter ..... 402/13

FOREIGN PATENT DOCUMENTS 517108 12/1992 European Pat. Off. ..... 402/13

0 517 108B1 12/1995 European Pat. Off. .

4118117 12/1992 Germany ..... 402/13

*Primary Examiner*—Frances Han

*Attorney, Agent, or Firm*—Collard & Roe, P.C.

[57] ABSTRACT

A ring binder having an upper and a lower cover blank joined by a flexible rear blank. The binder has at least two aligning tongues extending from the lower cover blank to the upper cover blank for retaining perforated paper. Each aligning tongue is formed as a leaf spring and has a root section, a center section and a tip section, wherein the sides of the center section being narrower than the root. The binder has U-shaped brackets on the upper cover blank for receiving the aligning tongues. A tie section of U-shaped cross section is attached substantially perpendicular to the root section. The tie section has legs having flanges extending outwardly from the free end of the legs. The aligning tongues are configured to be integral with one of the flanges via a reduced cross section in the lower portion of the aligning tongues.

9 Claims, 4 Drawing Sheets

Fig. 6
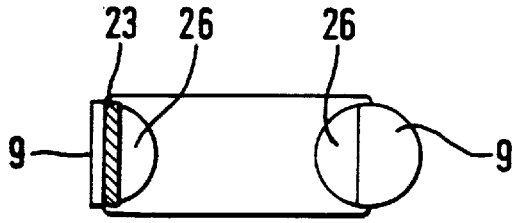
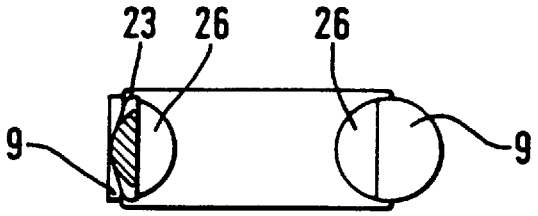
Fig. 7

RING BINDER WITH ALIGNMENT BLADE TONGUES

BACKGROUND OF THE INVENTION

1. Field of the Invention

The invention is a ring binder with alignment blade tongues. The ring binder has an upper and lower cover blank joined by a flexible rear blank. Extending from the lower cover blank to the upper cover blank are two aligning tongues. These aligning tongues retain perforated paper sheets, and run through U-shaped brackets in the upper cover blank.

2. The Prior Art

European Patent no. 0 517, 108 A1 shows a ring binder, having a cover and aligning tongues which are configured as separate parts. The aligning tongues are designed so that the lower part has a reduced cross section to allow the tongue to deform into an arch When the ring binder is opened. Unfortunately, this design was not optimal because of the elastic distribution in the longitudinal direction of the aligning tongue. In addition, the profile of the aligning tongue formed an obstacle in the middle portion of the paper sheets when pages were turned.

Additional problems occurred when the tie section of the aligning tongue detached itself from the cover blank when the ring binder fell down. Or, the aligning tongue broke at the tie section during transport of the ring binder.

SUMMARY OF THE INVENTION

It is therefore an object of the present invention to overcome the drawbacks of the prior art and to modify a ring binder having aligning tongues designed to have a more favorable elasticity distribution in the longitudinal direction. Another object of the invention is to create a ring binder wherein, the movements of the aligning tongue are operationally safe when the ring binder is opened and closed.

These problems are solved by a ring binder that has aligning tongues having a central section and a root section. These tongues have a concave profile where the central section has a smaller width than the root section and an increased height on a rear face. The sides of the central section are configured as concave recesses on the rear of the aligning tongue in which all the edges of the aligning tongue have a radius.

This design is desirable because the aligning tongues achieve a more appropriate distribution of the elasticity in the longitudinal direction. The result is that the aligning tongue is deformed in such a way so that upon opening and closing the ring binder, an arch is formed for easy turning of the pages of paper sheets without damaging them. In addition, when the rings are closed, the aligning tongue is returned to its initial position.

Thus, in the tip section of the aligning tongue, there are two stops, each of which is adapted to optionally engage the bows or U-shaped brackets in the upper cover blank of the ring binder. This design ensures that there is always an arch-shaped configuration of the aligning tongue when the binder has been opened irrespective of the thickness of the paper.

Another advantageous embodiment of the invention is the small height of the stops. This design ensures that no impressions of the stops develop on the rear cover blank of an empty ring binder during transport which would impair the aesthetic appearance of the ring binder.

Another advantageous embodiment of the invention provides a tie section having a width which approximately matches the root section. This results not only in saving in material but also in an improved aesthetic overall aspect of the ring binder.

This invention in also designed to ensure simple mounting of the aligning tongue in the rear cover blank, and secure support of the aligning tongue in the rear cover blank. To achieve this, the tie section has semicircular shoulders on its inside; in addition, the flange is semicircular and arranged at the free end of the tie section.

Finally, the invention consists of a leaf spring which is positioned substantially perpendicular to the bridge portion of the U-shaped tie section in the untensioned state. This design facilitates the arrangement of the perforated sheets in the ring binder.

Due to this particular profile in the longitudinal direction, the aligning tongue ensures gentle guiding of the paper. Furthermore, the socket shaped form of the shoulders on the tie section results in increased strength of the tie section is obtained so that the tie section is prevented from breaking when the ring binder falls onto the floor.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views:

FIG. 6 is a cross section of the aligning tongue in the direction of arrow A; and FIG. 7 is a cross section of the aligning tongue in the direction of arrow B.

DETAILED DESCRIPTION OF THE PREFERRED EMBODIMENT

Figure 1:
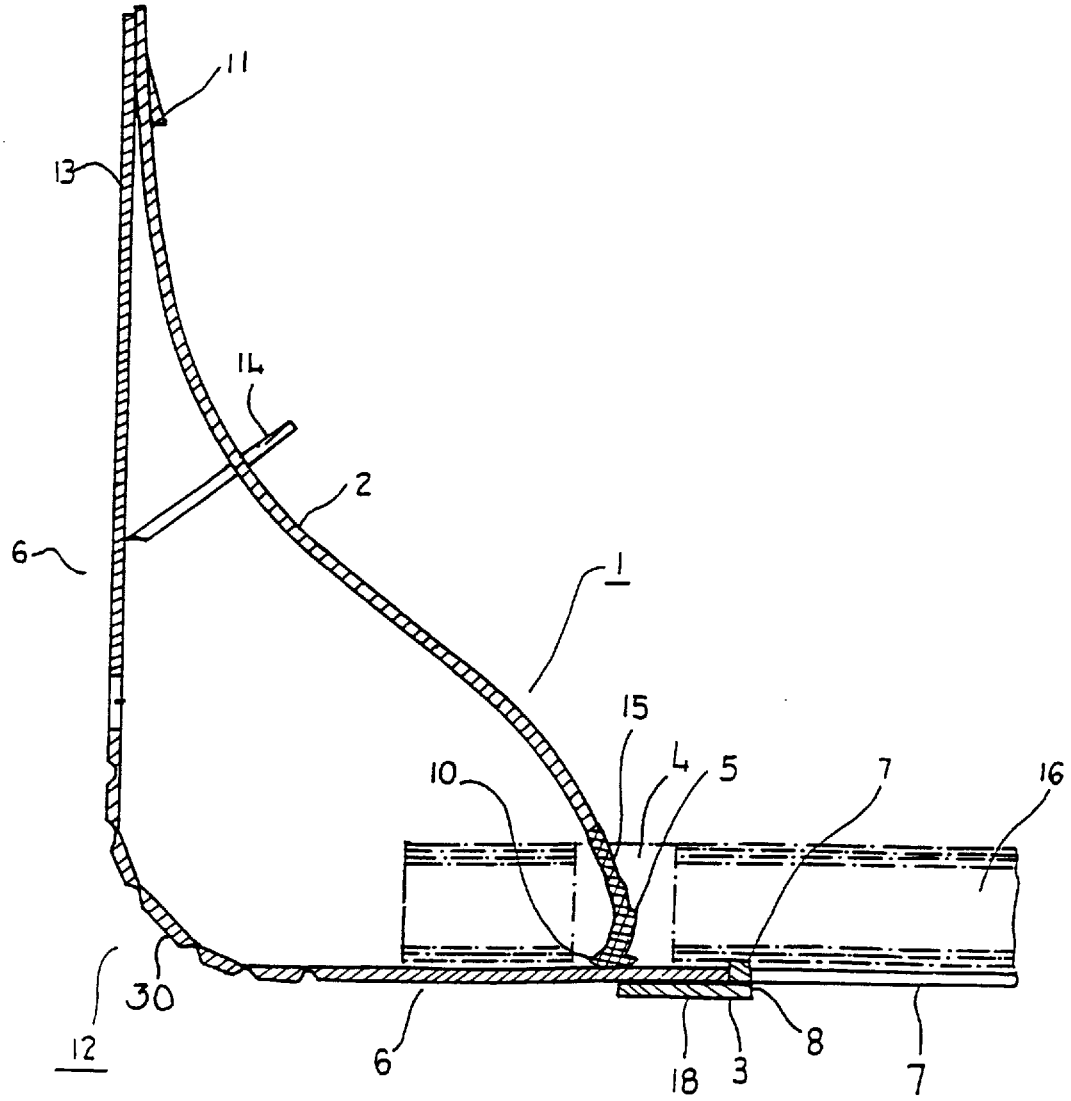
FIG. 1 is a side view of the aligning tongue together with a ring binders.
Figure 2:
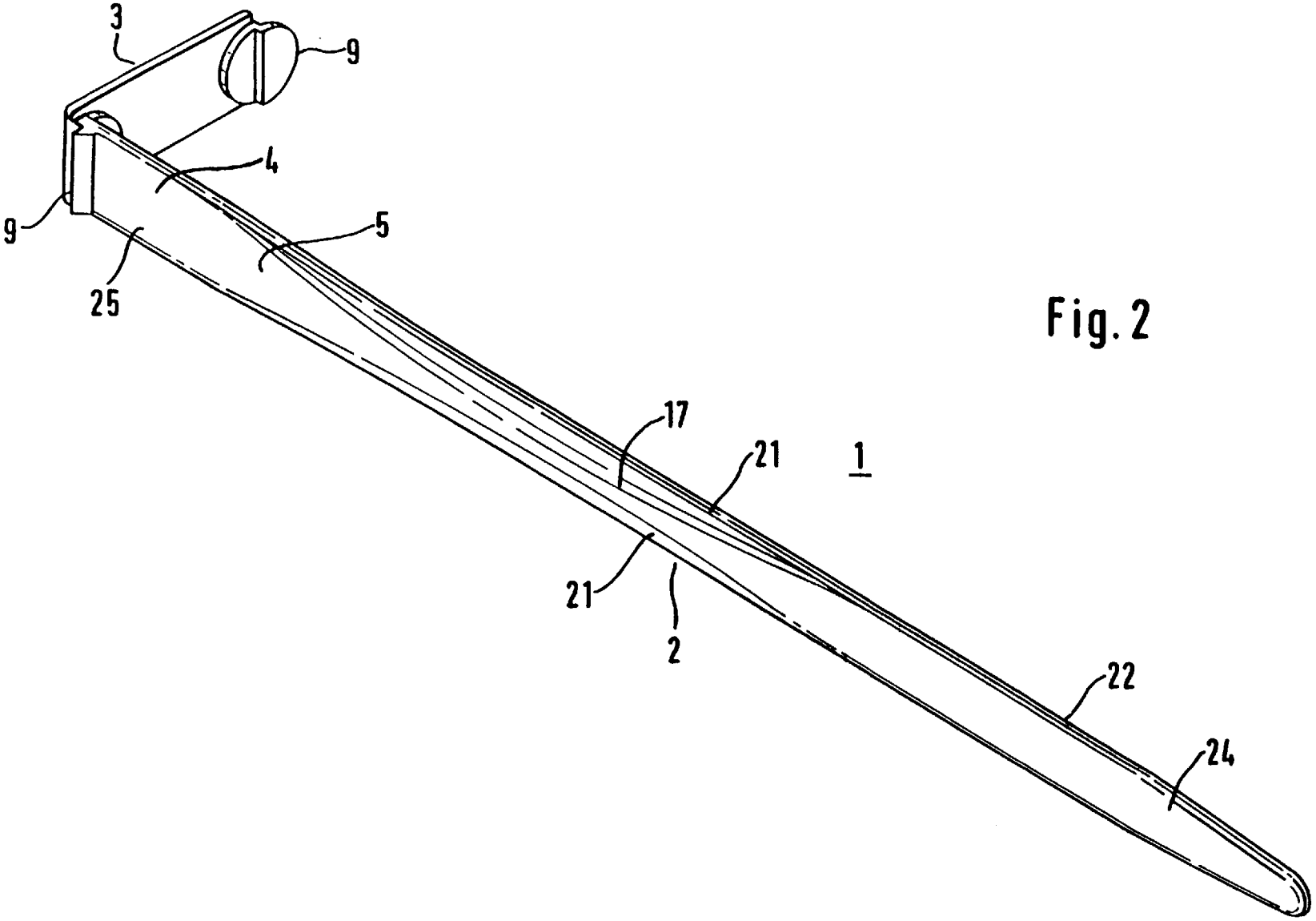
FIG. 2 is a perspective view of the aligning tongue.
Figure 4:
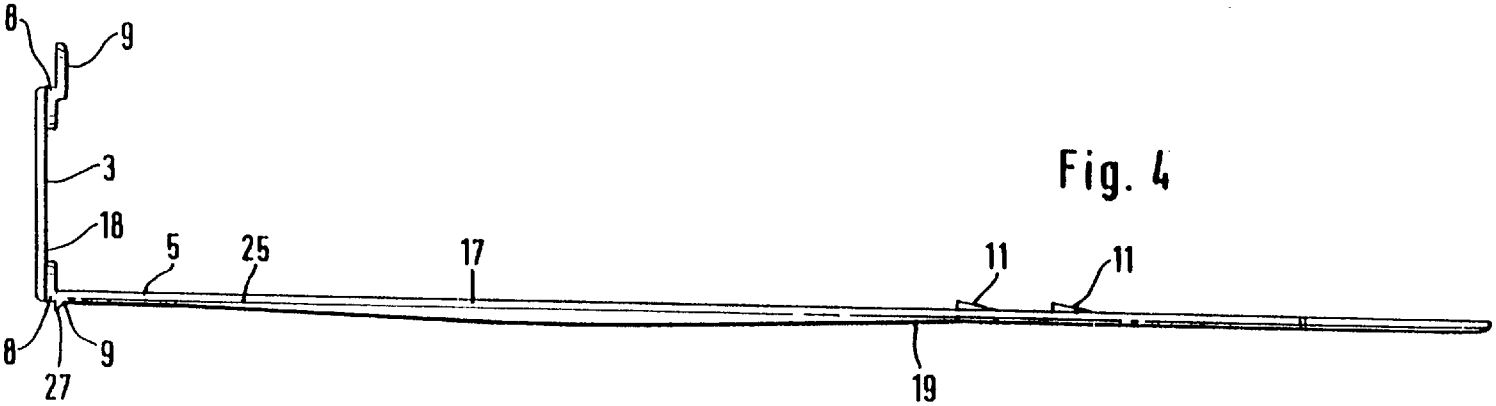
FIG. 4 is a side view of the aligning tongue.

Aligning tongue 1 shown in the figures is basically composed of aligning tongue section 2, tie section 3 and articulated portion 4 arranged in root section 25 of the aligning tongue. Articulated portion 4 functions as a leaf spring 5. In FIG. 2, this is shown by a reduction of the cross section in the lower part of aligning tongue 1. In addition to root section 25, aligning tongue section 2 has a central section 17 and a tip section 24. When compared to root section 25, central section 17 of aligning tongue 1 has reduced width and increased height on rear 19. Sides 20 of central section 17 are configured as concave recesses 21 waistline on rear 19 of aligning tongue 1, and all edges 22 of aligning tongue 1 have a radius 23. Tip section 24 of aligning tongue 1 has two stops 11 each of which Is adapted to optionally engage bows or U-shaped brackets 14 in upper cover blank 13 of ring binder 12. Stops 11 as shown in FIG. 4, are low in height. Upper cover blank 13 joins lower cover blank 6 by flexible rear blank 30.

Tie section 3 has a generally U-shaped cross section and comprises a bridge portion 18 and flanges 9 extending outward from the extremities of legs 8. Leaf spring 5 is integral with one of flanges 9, at a perpendicular angle, as long as the aligning tongue is in its untensioned state.

Figure 3:
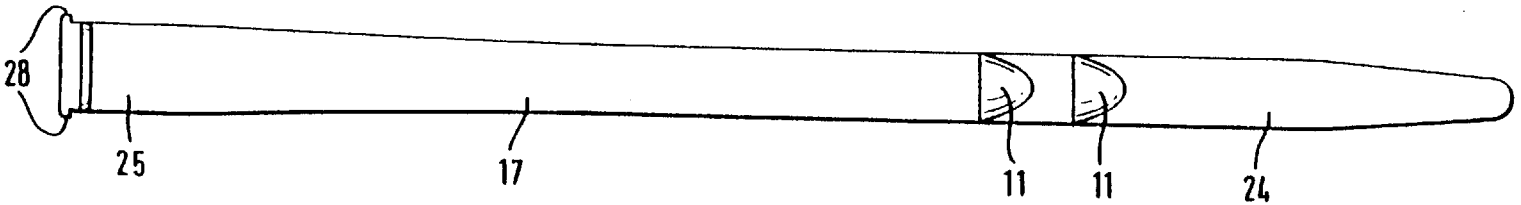
FIG. 3 is a view on the rear of the aligning tongue.
Figure 5:
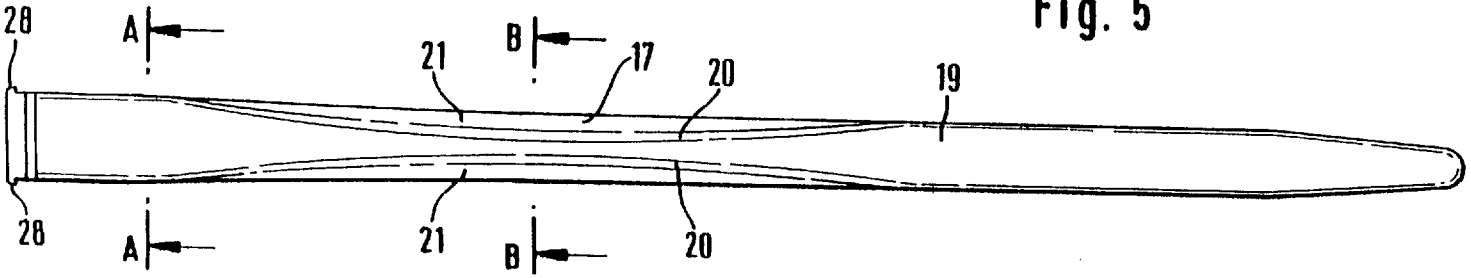
FIG. 5 is a view of the aligning tongue from the front.

Tie section 3 has a width which approximately matches root section 25. The tie section's sides which are parallel to the longitudinal direction of aligning tongue 1 (see FIGS. 3 and 5) protrude slightly beyond root section 25 of the aligning tongue.

The inside of bridge portion 18 of tie section 3, has semicircular shoulders 26 which engage semicircular openings 10 in lower cover blank 6 or rear part 7. In addition, legs 8 or flanges 9 of the U-shaped tie section 3 enter into lower cover blank 6 or rear part 7 to establish a junction. Flange 9 arranged at the end of aligning tongue 1, extends perpendicular thereto, and is configured as a short protrusion 27 of triangular cross section.

To use the ring binder, aligning tongue 1 is first locked with its tie section 3 into semicircular openings 10 of lower cover blank 6. Tongue 1 passes through perforations 15 of stack 16 of sheets to be filed. After that, it is run through bow, or U-shaped bracket 14. When ring binder 12 is opened, aligning tongue 1 by virtue of its elasticity distribution, forms an arched configuration which facilitates gentle turning of the various sheets of paper. In addition, stops 11 prevent aligning tongue 1 from sliding out of bow 14, irrespective of the height of the stack of sheets. When the ring binder is being closed, aligning tongue 1 by virtue of its elasticity distribution is guided by the bridge portion of bow 14, whereby aligning tongue 1 is prevented from folding.

Accordingly, while only several embodiments of the present invention have been shown and described, it is obvious that many changes and modifications may be made thereunto without departing from the spirit and scope of the invention.

What is claimed is:

1. A ring binder with alignment blade tongues, comprising:

one upper and one lower cover blank joined by a flexible rear blank;

at least two aligning tongues extending from the lower cover blank to the upper cover blank for retaining perforated paper sheets having i) a root section;

ii) a central section connected with said root section, and having a smaller width than said root section;

iii) a tip section connected to said central section;

iv) an articulated portion disposed in the region of the lower cover blank which functions as a leaf spring;

U-shaped brackets located on said upper cover blank, wherein said aligning tongues feed through said U-shaped brackets;

a tie section of U-shaped cross section attached substantially perpendicular to said root section on said aligning tongues;

legs having a free end located on the tie section; and flanges extending outwardly from the free end of the legs wherein one of the flanges integrally formed by the tongues has a reduced cross section in the lower portion of the aligning tongues.

2. The ring binder with aligning tongues according to claim 1, further comprising at least one stop, located in the tip section of the aligning tongue, which is adapted to engage said U-shaped brackets.

3. The ring binder with aligning tongues according to claim 2, wherein said at least one stop protrudes out only slightly from the aligning tongue.

4. The ring binder with aligning tongues according to claim 1, wherein the tie section has a width which approximately corresponds to the width of the root section of the aligning tongue.

5. The ring binder with aligning tongues according to claim 1, wherein the sides of the tie section that are parallel to the longitudinal direction of the aligning tongue protrude slightly beyond the root section of the aligning tongue.

6. The ring binder with aligning tongues according to claim 1, wherein the tie section has a bridge portion that includes semicircular shoulders on its inside surface.

7. The ring binder with aligning tongues according to claim 1, wherein the flange disposed at the end of the tie section is semicircular.

8. The ring binder with aligning tongues according to claim 1, wherein the flange arranged at the end of the aligning tongue is configured as a short protrusion of triangular cross section, arranged perpendicular to the longitudinal direction of the aligning tongue.

9. The ring binder with aligning tongues according to claim 1, wherein the leaf spring is positioned substantially perpendicular to the bridge portion of the U-shaped tie section in the untensioned state.

* * * * *